United States Patent [19]

Sindlinger

[11] Patent Number: 4,659,308

[45] Date of Patent: Apr. 21, 1987

[54] PHOTOFLASH LAMP WITH IMPROVED PRIMER

[75] Inventor: Ronald E. Sindlinger, Muncy, Pa.

[73] Assignee: GTE Products Corporation, Danvers, Mass.

[21] Appl. No.: 807,400

[22] Filed: Dec. 10, 1985

[51] Int. Cl.[4] ..... F21K 5/00

[52] U.S. Cl. ..... 431/362

[58] Field of Search ..... 431/362

[56] References Cited

U.S. PATENT DOCUMENTS

| | | | |
|---|---|---|---|
| 3,602,619 | 8/1971 | Van der Tas et al. . | |
| 3,627,459 | 12/1971 | Van der Tas et al. . | |
| 3,685,947 | 8/1972 | Meulemans et al. . | |
| 3,823,994 | 7/1974 | De Graaf et al. . | |
| 3,884,615 | 5/1975 | Sobieski . | |
| 3,930,784 | 1/1976 | Anderson . | |
| 3,969,067 | 7/1976 | Schupp . | |
| 4,059,389 | 11/1977 | Armstrong et al. . | |
| 4,190,413 | 2/1980 | Shaffer et al. | 431/362 |
| 4,229,161 | 10/1980 | Bouchard et al. | 431/362 |
| 4,249,887 | 2/1981 | De Caro et al. | 431/365 |
| 4,278,420 | 7/1981 | Bouchard et al. | 431/362 |
| 4,302,182 | 11/1981 | Shaffer | 431/362 |
| 4,369,028 | 1/1983 | Bricker et al. | 431/362 |
| 4,388,065 | 6/1983 | Martens | 431/362 |

*Primary Examiner*—Carroll B. Dority, Jr.

*Attorney, Agent, or Firm*—Martha Ann Finnegan

[57] ABSTRACT

A high-voltage photoflash lamp is provided wherein the lead-in wires are electrically insulated from the metallic shreds therein by including electrically insulating beads in the primer material. The primer also includes combustible metal powder, an oxidizing agent, and a binder, wherein at least part of the combustible metal powder in the primer is in large particle form.

15 Claims, 1 Drawing Figure

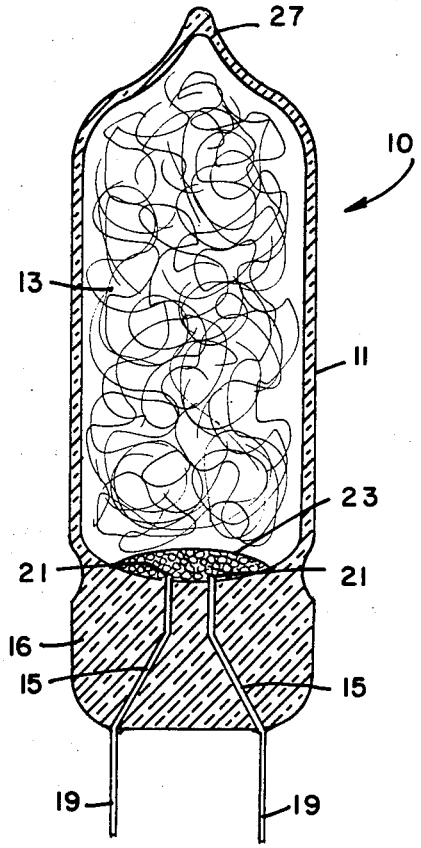
27
10
13
11
23
21
21
16
15
15
19
19

PHOTOFLASH LAMP WITH IMPROVED PRIMER

BACKGROUND OF THE INVENTION

The present invention relates to photoflash lamps and more particularly to high-voltage photoflash lamps.

A high-voltage flash lamp typically includes a glass envelope with a combustion-supporting gas and a quantity of filamentary, combustible material therein. A pair of electrically conductive lead wires is usually sealed in one end of the envelope and extend within the envelope. Medial portions of the extending ends of the lamp's conducting wires are located within a glass or ceramic bead. Primer material serves to bridge the portions of the ends which project through the bead. Flashing is accomplished by a firing pulse approaching a few thousand volts which is provided by a piezoelectric element. In another type of high-voltage lamp, the primer is located within an indentation in the bottom of the lamp and the conductive wires extend therein.

Understandably, it is highly desirous to prevent shred interference with the lamp's ignition. Shred interference can occur primarily in one of two ways: either by the shreds contacting and shorting the exposed portions of the lead wires within the envelope or by the shreds contacting and lying across the primer material surface.

In either case, the ignition voltage characteristics are altered, which in some instances can even prevent the lamp from firing. Shred interference can also reduce the firing voltage to the point that ignition is possible electrostatically. In situations wherein the lamp is used in circuitry containing several other lamps (e.g., sequential or random flash embodiments), an altered ignition voltage substantially reduces the lamp's compatibility with the desired circuit.

Various techniques for preventing shred interference with a lamp's ignition are illustrated. For example, in U.S. Pat. Nos. 3,884,615 and 3,685,947 a hollow glass bead is supported by the inner ends of the lead wires and primer is put into the cavity of the bead to electrically connect the two lead wires. This construction is bulky and does not permit miniaturization of the flash lamp. In addition, the beads are costly, and their mass, which is relatively isolated from the bulb, interferes with rapid cool down and liquification of oxygen, thereby limiting machine speeds.

In U.S. Pat. Nos. 3,823,994 and 3,627,459, the inner ends of the lead wires are exposed inside a small length of glass tubing which is sealed into the press. A quantity of primer within the tube connects the two lead wires electrically. This construction is costly in that it requires small pieces of fabricated glass tubing.

U.S. Pat. No. 4,229,161 teaches the use of a device, such as a disc of mica, to isolate electrically the shreds in the lamp from the primer. The beaded construction is also shown. Both the bead and the mica disc add considerably to the cost of the lamp and to the difficulty of cooling the lamp and thereby pressuring the lamp with oxygen.

It would be desirable to have a high-voltage photoflash lamp with improved reliability in which the shredded fill is insulated from the internal leads, the structure of which does not impede rapid cool down.

SUMMARY OF THE INVENTION

In accordance with the present invention there is provided a high-voltage photoflash lamp comprising an hermetically-sealed light-transmitting envelope including a combustion-supporting atmosphere therein; a quantity of filamentary combustible material located within said envelope; ignition means for igniting said combustible material, said ignition means including a pair of electrical conductors sealed within said envelope and projecting therefrom, each of said conductors including an end portion having access to the interior of said envelope, a mass of primer located within said envelope in electrical contact with said end portions of said electrical conductors, said primer material comprising a mixture of a combustible metal powder, an oxidizer, a binding agent, and solid electrically insulating beads, wherein at least a part of said combustible metal powder is in large particle form.

BRIEF DESCRIPTON OF THE DRAWING

In the FIGURE there is shown a high-voltage photoflash lamp in accordance with the present invention.

For a better understanding of the present invention together with other and further objects, advantages, and capabilities thereof, reference is made to the following disclosure and appended claims in connection with the above-described drawing.

DETAILED DESCRIPTION OF THE INVENTION

With particular attention to the FIGURE, there is shown a photoflash lamp 10 which comprises an hermetically-sealed, light-transmitting envelope 11 having a combustion-supporting atmosphere and a quantity of combustible filamentary material 13 therein. Envelope 11 is manufactured from a tubular glass (e.g., lime glass) member having opposing ends. A pair of spaced-apart electrical conductors 15 are press-sealed within one end (16) of the tubular glass member such that portions 19 of these conductors project externally therefrom. Conductors 15 also include end portions 21 which have access to the interior of the envelope 11 such that a mass of primer material 23 may be placed in electrical contact therewith. Conductors 15 and primer 23 comprise the means for igniting combustible material 13 when an electrical pulse is applied thereto. Both of the conductors 15 are buried in the primer 23, rather than having one conductor extend into the combustible material 13.

The pulse is preferably supplied by a piezoelectric element (not shown) located externally of lamp 10. Application of the pulse across the conductors 15 results in intense deflagration of primer 23, which in turn ignites the main charge of the lamp, i.e., combustible material 13.

As stated, envelope 11 is glass. The primer comprises a mixture of a combustible metal powder, an oxidizer, a binding agent, and a quantity of electrically insulating beads, wherein at least a part of the combustible metal powder is in large particle form. The quantity of electrically insulating beads preferably represents from about 35 to about 65 weight percent of the primer. Preferably the ratio of the weight percent of the electrically insulating beads in the primer to the weight percent of the large particle form combustible metal powder in the primer is from about 5 to 1 to about 10 to 1. Large particle form combustible metal powder has an average particle size greater than about 2 microns. Preferably the large particle metal powder has an average particle size greater than about 2 microns and less than about 10 microns. The total weight percent of combustible metal powder in the primer is preferably from about 30 to about 50 weight percent. Typical amounts of oxidizer and binding agent in the primer are use in the present primer composition. For example, the typical amounts of binder (e.g., nitrocellulose or polyvinylpyrrolidone) are from about 0.5 to about 3 weight percent; typical amounts of oxidizer are from about 3 to 9 weight percent. The most preferred primer material 23 is a mixture of approximately 6 weight percent zirconium powder with an average particle size of greater than about 2 to about 3 microns (large particle), approximately 36 weight percent zirconium powder with an average particle size from about 1 to about 2 microns, approximately 6 weight percent potassium perchlorate (oxidizer), approximately 1 weight percent polyvinylpyrrolidone (binder), and approximately 50 weight percent solid glass beads having an average diameter of about 0.008 inches. Conductors 15 are preferably 0.016 inch diameter wires comprising a nickel-iron alloy. The points at which the two wires emerge from the envelope are preferably located about 0.150 inches apart. The preferred combustible material 13 is shredded zirconium or hafnium, while the preferred supporting atmosphere is oxygen. Typically, the oxygen is established at a pressure of several atmospheres.

The presence of the electrically insulating beads in the primer insulates the shredded fill from the internal leads in a photoflash lamp thereby reducing interference with lamp firing.

The beads used in the primer have an average diameter from about 0.005 inches to about 0.020 inches. The electrical path in the lamp is lengthened when solid electrically insulating beads are mixed into a conventional primer of zirconium, potassium perchlorate and nitrocellulose, wherein all of the zirconium powder has an average particle size within the same particle size range of approximately 1–2 microns. Such elongated electrical path promotes very high voltage breakdown which is extremely undesirable in a high-voltage photoflash lamp. High voltage breakdown causes lamp failures because the voltage needed to flash the lamp may exceed that provided by the camera. The primer material is added to the tubular glass member in liquid condition. The liquid condition is achieved by adding a suitable solvent to the primer material mixture. A suitable solvent is one which can be fully evaporated under the time and temperature conditions selected for the drying step of the lamp fabrication process. After the primer material is provided in the tubular glass member and the solvent is evaporated, the shredded combustible material is positioned in the lamp, and the opposing end 27 of the glass tubing is sealed to define the ultimate configuration of the envelope 11. The preferred method for effecting this seal involves a tipping operation well known in the photoflash lamp art. Such high voltage breakdown is essentially eliminated by the present primer composition.

EXAMPLE

A high-voltage flash lamp having a light-transmitting envelope with a 5.2 mm inside diameter and a volume of about 0.30 $cm^3$ was fabricated.

A pair of lead-in wires was sealed into a first end of an elongated light-transmitting tube such that one end of each lead-in wire extended to the exterior of the sealed end and the opposing end of each lead wire extended into the interior of the glass tube. The ends of the lead-in wires extending into the interior of the tubular glass member extend into the envelope a distance approximately equal to the diameter of a single lead-in wire, i.e., approximately 0.016 inches. The lead-in wires (51% by weight of Ni, and 49% by weight of Fe) had a diameter of about 4.1 mm.

A quantity of primer in liquid condition, i.e., a mixture of solvent and primer was positioned within the tube through the second open end thereof. The primer—solvent mixture included about 3 weight percent propylene glycol, about 9 weight percent dipropylene glycol methylether, about 2 weight percent distilled water, about 1 weight percent polyvinyl-pyrrolidone, about 5 weight percent potassium perchlorate, about 36 weight percent zirconium and about 43 weight percent glass beads, wherein about one-seventh of the total zirconium or 5 weight percent of the primer-solvent mixture was large particle zirconium. The solvent was evaporated from the mixture and blown off by heating with gradual increase in temperature over an approximately 30–45 second time period. Gradual heating is used to remove the water component of the mixture first, the dipropylene glycomethyl ether component of the mixture second, and the propylene glycol component of the mixture last. (The water component evaporates at about 100° C.; the dipropylene glycol methyl ether component evaporates at about 167° C.; and the propylene glycol component evaporates at about 214° C.) After the propylene glycol, dipropylene glycol-methyl ether, and distilled water solvent mixture was evaporated, the approximately 4 mg of primer consisted of about 50% by weight electrically insulating beads, about 42% by weight zirconium, about 6% by weight potassium perchlorate, and about 1% by weight polyvinylpyrrolidone, wherein about one-seventh of the total zirconium, or about 6% by weight of the total primer was large particle zirconium. The large particle zirconium used in the present example had an average particle size greater than about 2 to about 3 microns. The balance of the zirconium powder had an average particle size of about 1 to about 2 microns, which particle size is conventionally used in primer material. The weight percent ratio of the glass beads to the large particle zirconium was about 8 to 1. The beads used were solid glass beads having a diameter of about 200 microns and had an average density of about 2.50 $g/cm^3$.

A quantity of 10 mg zirconium shreds was positioned in the glass tube and the oxygen gas was introduced therein after which the second open end was sealed to form the envelope of the finished lamp.

Thus there has been shown and described a photoflash lamp which represents a substantial improvement over lamps of the prior art. A method of making this lamp has also been described.

While there have been shown and described what are at present considered the preferred embodiments of the invention, it will be obvious to those skilled in the art that various changes and modifications may be made therein without departing from the scope of the invention as defined by the appended claims.

What is claimed is:

1. A high-voltage photoflash lamp comprising:

an hermetically-sealed light-transmitting envelope including a combustion-supporting atmosphere therein;

a quantity of filamentary combustible material located within said envelope:

ignition means for igniting said combustible material, said ignition means including a pair of electrical conductors sealed within said envelope and projecting therefrom, each of said conductors including an end portion having access to the interior of said envelope:

a mass of primer material located within said envelope in electrical contact with said end portions of said electrical conductors, said primer material comprising a mixture of a combustible metal powder, an oxidizer, a binding agent, and electrically insulating beads having an average diameter of from about 0.005 inches to about 0.020 inches, wherein part of said combustible powder is in large particle form.

2. A high-voltage photoflash lamp in accordance with claim 1 wherein the electrically insulating beads are glass.

3. A high-voltage photoflash lamp in accordance with claim 1 wherein the electrically insulating beads are ceramic.

4. A high-voltage photoflash lamp in accordance with claim 1 wherein the solid electrically insulating beads are present in an amount from about 35 to about 65 weight percent of the primer material.

5. A high-voltage photoflash lamp in accordance with claim 4 wherein weight percent ratio of electrically insulating beads to large particle combustible metal powder is from about 5 to 1 to about 10 to 1.

6. A high-voltage photoflash lamp comprising:

a hermetically-sealed light-transmitting envelope including a combustion-supporting atmosphere therein:

a quantity of filamentary combustible material consisting essentially of zirconium shreds located within said envelope:

ignition means for igniting said combustible material, said ignition means including a pair of electrical conductors sealed within said envelope and projecting therefrom, each of said conductors including an end portion having access to the interior of said envelope:

a mass of primer material located within said envelope in electrical contact with said end portions of said electrical conductors, said end portions of said electrical conductors being buried in said primer material, said primer material comprising a mixture of about 42 weight percent zirconium, about 6 weight percent potassium perchlorate, about 1 weight percent polyvinylpyrrolidone, and about 50 weight percent glass beads, wherein part of the zirconium is in large particle form having an average particle size greater than about 2 microns and less than about 10 microns.

7. A high-voltage photoflash lamp in accordance with claim 6 wherein the weight percent ratio of glass beads to large particle zirconium is about 8:1.

8. A high-voltage photoflash lamp in accordance with claim 6 wherein the glass beads have a diameter of about 0.005 inches to about 0.020 inches.

9. A high-voltage photoflash lamp comprising:

an hermetically-sealed light-transmitting envelope including a combustion-supporting atmosphere therein:

a quantity of filamentary combustible material consisting essentially of zirconium shreds located within said envelope:

ignition means for igniting said combustible material, said ignition means including a pair of electrical conductors sealed within said envelope and projecting therefrom, each of said conductors including an end portion having access to the interior of said envelope:

a mass of primer material located within said envelope in electrical contact with said end portions of said electrical conductors, said end portions of said electrical conductors being buried in said primer material, said primer material comprising a mixture of about 42 weight percent zirconium: about 6 weight percent potassium perchlorate: about 1 weight percent polyvinylpyrrolidone: and about 50 weight percent glass beads, said glass beads having a diameter of about 0.005 inches to about 0.020 inches, wherein at least part of the zirconium is in large particle form, the large particle zirconium having an average particle size greater than about 2 microns and less than or equal to about 3 microns.

10. A high-voltage photoflash lamp comprising:

an hermetically-sealed light-transmitting envelope including a combustion-supporting atmosphere therein:

a quantity of filamentary combustible material located within said envelope:

ignition means for igniting said combustible material, said ignition means including a pair of electrical conductors sealed within said envelope and projecting therefrom, each of said conductors including an end portion having access to the interior of said envelope:

a mass of primer material located within said envelope in electrical contact with said end portions of said electrical conductors, said primer material comprising a mixture of a combustible metal powder, an oxidizer, a binding agent, and about 35 to about 65 weight percent electrically insulating beads, wherein part of said combustible powder is in large particle form, said large particle form combustible metal powder having an average particle size greater than about 2 microns and less than about 10 microns and the balance of the combustible metal powder has an average particle size from 1 to about 2 microns, said electrically insulating beads and the large particle form combustible metal powder being present in said primer material in a weight percent ratio of about 5/1 to about 10/1.

11. A high-voltage photoflash lamp in accordance with claim 10 wherein the electrically insulating beads are glass.

12. A high-voltage photoflash lamp in accordance with claim 10 wherein the electrically insulating beads are ceramic.

13. A high-voltage photoflash lamp in accordance with claim 10 wherein the beads have an average diameter from about 0.005 inches to about 0.020 inches.

14. A high-voltage photoflash lamp in accordance with claim 10 wherein the large particle form combustible metal powder has an average particle size greater than about 2 microns and the balance of the combustible metal powder has an average particle size from about 1 to about 2 microns.

15. A high-voltage photoflash lamp comprising:

an hermetically-sealed light-transmitting envelope including a combustion-supporting atmosphere therein;

a quantity of filamentary combustible material located within said envelope;

ignition means for igniting said combustible material, said ignition means including a pair of electrical conductors sealed within said envelope and projecting therefrom, each of said conductors including an end portion having access to the interior of said envelope;

a mass of primer material located within said envelope in electrical contact with said end portions of said electrical conductors, said primer material comprising a mixture of a combustible metal powder, an oxidizer, a binding agent, and electrically insulating beads, wherein part of said combustible powder is in large particle form having an average particle size greater than about 2 microns and less than about 10 microns and the balance of the combustible metal powder has an average particle size from about 1 to about 2 microns.

* * * * *